United States Patent [19]

Maye

[11] Patent Number: 4,987,611

[45] Date of Patent: Jan. 29, 1991

[54] PROTECTIVE DEVICE FOR BASEBALL PLAYER

[76] Inventor: Franklin H. Maye, 3143 Omega Ave., Simi Valley, Calif. 93063

[21] Appl. No.: 386,270

[22] Filed: Jul. 28, 1989

[51] Int. Cl.[5] ..... A41D 13/08

[52] U.S. Cl. ..... 2/19; 2/20

[58] Field of Search ..... 2/19, 20

[56] References Cited

U.S. PATENT DOCUMENTS

| | | | |
|---|---|---|---|
| 57,283 | 8/1866 | Brown | 2/20 X |
| 425,887 | 4/1890 | Kohler | 2/19 |
| 1,465,223 | 8/1923 | Kobbe | 2/19 X |
| 2,845,628 | 8/1958 | Dell | 2/20 |
| 3,146,463 | 9/1964 | Wargo | 2/20 |
| 3,890,648 | 6/1975 | Beal | 2/20 |
| 3,896,498 | 7/1975 | Pang | 2/20 |
| 4,176,407 | 12/1979 | Goebel et al. | 2/20 |
| 4,617,684 | 10/1986 | Green | 2/20 |
| 4,624,016 | 11/1986 | Luevano | 2/19 X |
| 4,658,441 | 4/1987 | Smith | 2/20 X |
| 4,748,670 | 6/1988 | Webster | 2/19 |
| 4,754,499 | 7/1988 | Pirie | 2/20 |
| 4,894,866 | 1/1990 | Walker | 2/20 X |

FOREIGN PATENT DOCUMENTS

| | | | |
|---|---|---|---|
| 267325 | 11/1913 | Switzerland | 2/20 |

*Primary Examiner*—Daniel P. Stodola
*Assistant Examiner*—John P. Darling

[57] ABSTRACT

A protective pad for use by a baseball player and to be worn under a catcher's mitt or first baseman's glove, for example, and which is conveniently supported on the thumb of the user and extends across the palm to protect the palm from injury.

3 Claims, 1 Drawing Sheet

PROTECTIVE DEVICE FOR BASEBALL PLAYER

BACKGROUND OF THE INVENTION

Protective devices have been proposed in the past for use in games such as baseball, in which a player's hand is subjected to repeated impact forces from catching baseballs traveling at high speeds. These forces have a tendency to cause the palm of the player's hand to become bruised, or to be otherwise injured, even though the player wears a baseball glove or mitt.

U.S. Pat. No. 3,890,648—Beal, for example, provides such a protective device which is intended to be worn by the player under his glove, and which is intended to provide added protection to the areas of the player's hand which are susceptible to injury from catching baseballs.

However, it has been found that the Beal device is somewhat awkward to put on and take off, and it also has a tendency to move out of position.

SUMMARY OF THE INVENTION

A protective pad is provided to be worn under a baseball mitt or glove, and which is formed of front and back panels of pliable material, with at least the front panel being padded. The front and back panels each has an arcuate configuration and defines an opening at their upper ends to receive the thumb of the user. The lower arcuate edges of the panels are unattached to permit the front panel to extend across the palm of the user and the back panel to extend across the back portion of the hand of the user between the thumb and forefinger.

With the construction described above, the protective device of the invention fits snugly over the thumb of the user to be firmly held in place, and yet to be easy to put on and to take off.

DETAILED DESCRIPTION OF THE ILLUSTRATED EMBODIMENT

Figure 1:
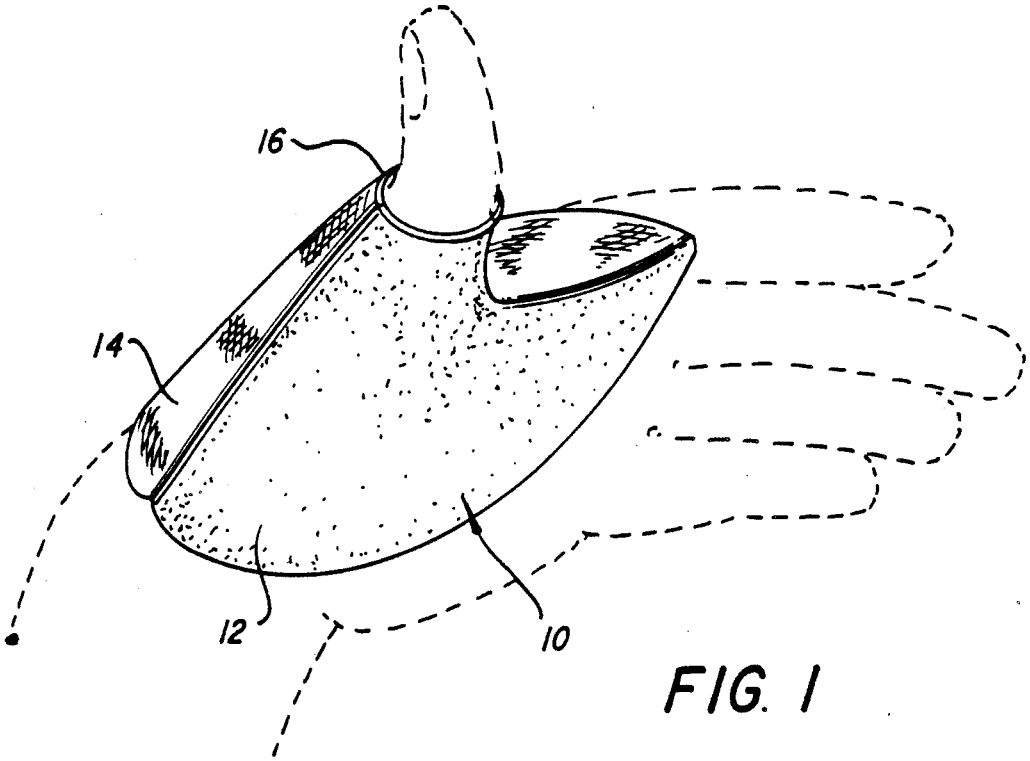
FIG. 1 is a front view of the protective device of the invention in place on the hand of a player.
Figure 2:
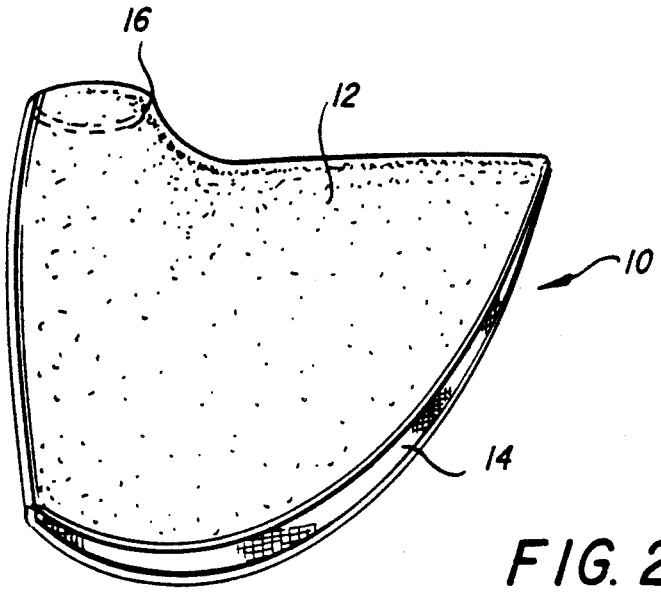
FIG. 2 is a perspective view of the protective device of FIG. 1.

The illustrated embodiment of the protective device of the invention is designated 10 in FIGS. 1 and 2. The protective device 10, as shown in FIG. 1 is mounted on the hand of the wearer to be supported by the wearer's thumb.

As shown in FIG. 2, the protective device 10 includes a padded front panel 12 and a back panel 14, both formed of a pliable material. The panels 12 and 14 have rectilinear top and rear edges, as shown, with the rectilinear edges being stitched together, and defining an opening 16 at the upper rear corner of the device for receiving the thumb of the user, as shown in FIG. 1.

The two panels each has an arcuate edge. The arcuate edges are unattached. They extend from the distal ends of the respective rectilinear top and rear edges, and they permit the front panel to extend at least partially across the palm of the user, as shown in FIG. 1, and the back panel to extend across the portion of the back of the hand between the thumb and forefinger, when the protective device is in place on the hand of the user, such as shown in FIG. 1.

The front panel 12 is formed of a padded pliable material, and the back panel, for example, is formed of a fabric material.

It will be appreciated that while a particular embodiment of the invention has been shown and described, modifications may be made. It is intended in the claims to cover all modifications which come within the true spirit and scope of the invention.

I claim:

1. A protective device to be worn on the hand and under the glove of a ball player constructed to be put on over the hand of a user without the hand passing through the device, said device including: a padded front panel and a back panel, both of said panels being substantially triangular in shape and having joined rectilinear side and top edges and unattached arcuate bottom edges, said side and top edges forming an opening for receiving the thumb of the user, and the front and back panels respectively covering the palm and back of the hand of the user without completely encircling the hand.

2. The protective device defined in claim 1, in which the front panel is formed of a padded pliable material and the back panel is formed of a fabric material.

3. The protective device defined in claim 1, in which the front and back panels are stitched to one another along the rectilinear side and top edges thereof.

* * * * *